United States Patent [19]

Benjamin

[11] 4,134,361

[45] Jan. 16, 1979

[54] BOWLING ALLEY CONDITIONING DEVICE

[76] Inventor: Herschel T. Benjamin, 944 NW. 96th, Seattle, Wash. 98117

[21] Appl. No.: 882,381

[22] Filed: Mar. 1, 1978

[51] Int. Cl.[2] ..... A47L 11/03; A47L 11/18

[52] U.S. Cl. ..... 118/73; 15/98; 118/108; 118/109; 118/120; 118/323

[58] Field of Search ..... 15/49 R, 49 C, 50 R, 15/50 C, 98, 51, 52; 118/72, 73, 108, 109, 120, 323; 51/176

[56] References Cited

U.S. PATENT DOCUMENTS

| | | | |
|---|---|---|---|
| 1,682,168 | 8/1928 | Dorl | 15/98 |
| 3,150,395 | 9/1964 | Lucky | 15/98 |
| 3,150,407 | 9/1964 | Mitchell | 15/98 X |

FOREIGN PATENT DOCUMENTS

| | | | |
|---|---|---|---|
| 937006 | 11/1973 | Canada | 15/98 |

*Primary Examiner*—Edward L. Roberts

[57] ABSTRACT

A fully automated apparatus for cleaning and conditioning bowling alleys including the scrubbing and re-oiling while simultaneously dusting the ball-return. The mechanism is suspended from a track mounted to the ceiling parallel to the bowling alleys and located between adjacent bowling alleys, the cleaning and conditioning mechanism is secured to the track by means of a rigid arm which is designed to be collapsed up against the track when not in use. The mechanism is driven along the track at a predetermined speed and solvent or oil is metered to be applied at an appropriate rate to assure a complete reconditioning. The cleaning of the alley is done as the mechanism moves toward the foul line and the oiling is completed on the return trip.

7 Claims, 5 Drawing Figures

BOWLING ALLEY CONDITIONING DEVICE

BACKGROUND OF THE INVENTION

For consistency and reliability in bowling, the alleys must be kept in a uniform condition. As the surface of the alley becomes too slippery, i.e. with an excess of oil or too dry i.e. with insufficient oil, the interaction between the ball and the alley is not consistent thus greatly impairing the ability of a bowler to consistently contact the pins at the proper location for maximum scores. It is imperative to the tournament bowler that he be able to consistently predict the roll of the ball to maximize his score and that the reaction not vary from alley to alley.

Many devices have been introduced into the industry to service bowling alleys but because of the time involved in servicing the alleys, a time when the alleys are unproductive, these devices have proven to be generally unsatisfactory. It further is unsatisfactory to service the alley only at the end of the day since this results in an extremely dry surface and excessive wear to the alley surface during the period just prior to the servicing.

It, of course, is possible to service the alleys by hand, probably the most reliable, but also the most time consuming. Machines have been developed which, when placed upon an alley, will automatically drive themselves towards and away from the pins cleaning and oiling the alley as they move. These machines are quite sophisticated and constructed such that they hop out of the ball return which serves as a guide upon completion of the servicing. One of the problems with the machines presently on the market, although they service the alley in an adequate fashion, is that they require a fair amount of alley down time during the servicing and further the devices are extremely expensive to purchase and maintain. It is because of these factors i.e. the down time for the alley and the expense of the maintenance equipment that the alleys are not serviced as often as is desired and particularly not during periods of peak use. A given bowling establishment normally does not have several servicing machines and therefore, must cycle the servicing thereby giving those bowlers who bowl early in the period following servicing a far greater advantage than those who bowl later in a tournament when a particular lane has become dry.

Because of the controls necessary to cause a servicing machine to move down the alley return and not cause damage to the alley or surrounding areas, the machines that have traditionally been used for this operation are tremendously expensive. This factor, as noted above, prevents alleys from owning several machines enabling the servicing of several alleys simultaneously.

With the above noted problems and prior art in mind, it is an object of the present invention to provide a mechanism for servicing bowling alleys which is both inexpensive and reliable allowing a bowling establishment to own more machines and thus enable more frequent servicing.

It is another object of the present invention to provide a device for servicing bowling alleys wherein two adjacent alleys are serviced simultaneously and the total down time for the alleys during servicing is kept to a minimum thereby permitting servicing of the alleys during a period of great demand without delay of a game or tournament.

Still another object of the present invention is to provide a mechanism for servicing bowling alleys wherein two laterally extending rigid arms extend from a central control mechanism. Each of the laterally extending arms includes a means to scrub the alley surface as well as a means to apply the necessary oil. The central control apparatus is supported from the ceiling or roof of the building and has an articulated arm which extends substantially vertically downwardly during operation and collapses upwardly against the ceiling or roof when the apparatus is not in use.

Still a further object of the present invention is to provide an alley cleaning and surfacing mechanism which is simple in construction, far less expensive than those mechanisms heretofore available and one which although not permanently installed does not detract from the appearance of the alleys.

Yet another object of the present invention is to provide a servicing mechanism for bowling alleys wherein the entire mechanism is self-contained, instantly available for use and further, one which, because of its simplicity, is reliable and requires very little maintenance.

DETAILED DESCRIPTION OF THE DRAWINGS

Figures 1, 2:
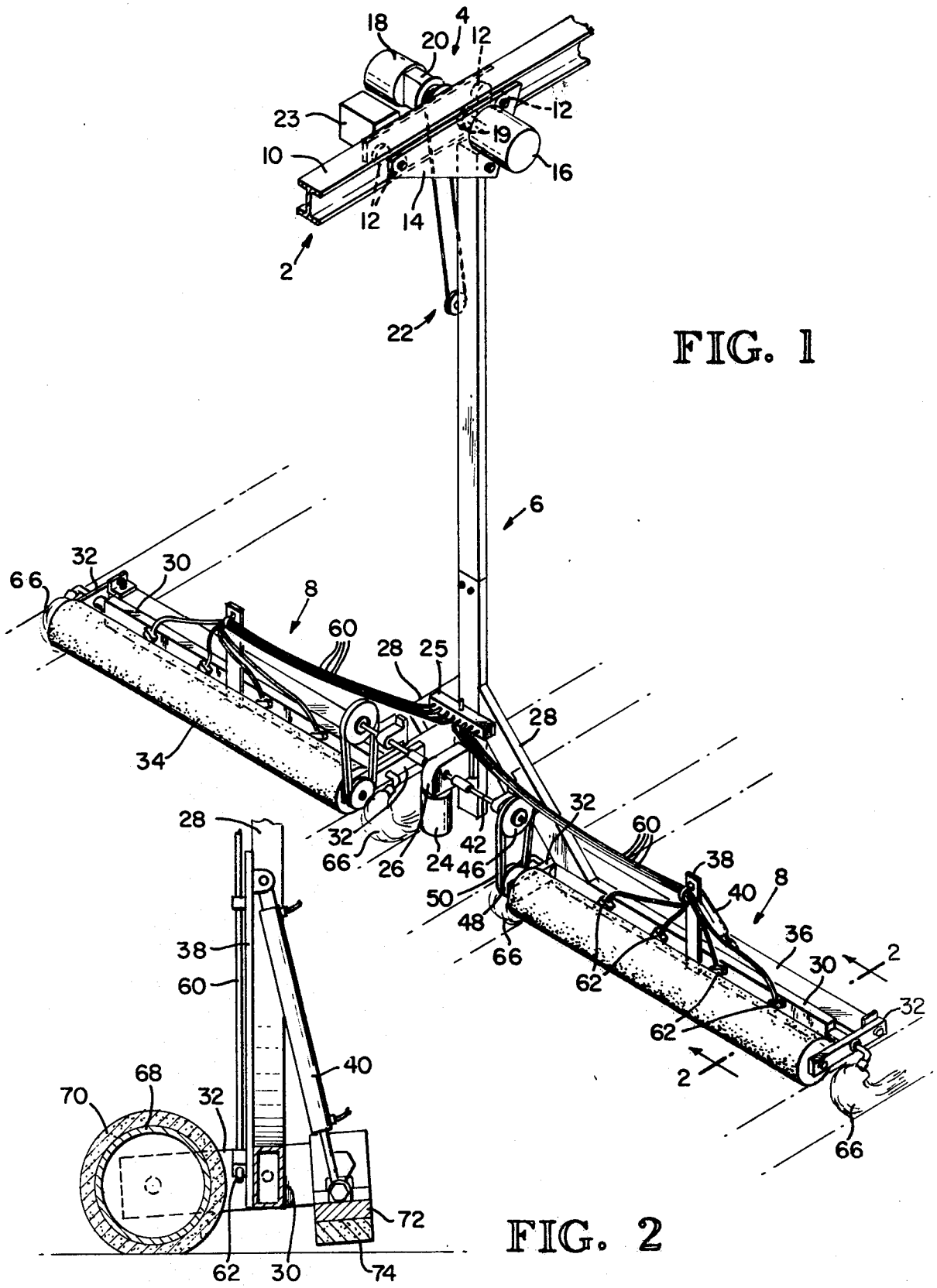
FIG. 1 is an isometric view of the inventive bowling alley servicing mechanism in position for servicing a pair of adjacent alleys.
FIG. 2 is an enlarged sectional view taken along lines 2—2 of FIG. 1 disclosing the relationship of the principle required elements of the mechanism.

As seen in FIG. 1, the bowling alley conditioner, conditions two adjacent alleys simultaneously and comprises in general a guiding mechanism 2, a general driving and control mechanism 4, a rigid arm 6 and a pair of identical conditioning apparatus 8.

The preferred embodiment of the present invention includes as a necessary part thereof, an I-beam type track element 10 secured to the ceiling or roof of the structure above the ball return gutter and adapted to support the entire apparatus during operation and storage. The apparatus is secured to the I-beam track 10 by a plurality of opposing wheel elements 12 which are mounted to opposite ends of downwardly extending cheek plates 14. Cheek plates 14 also serve as mounts for the driving motor 16 and the apparatus positioning motor 18 both of which will be explained in detail hereinafter. It is to be noted that driving motor 16 is of a reversible type and has mounted thereon a drive wheel 19 which frictionally contacts the flange of the I-beam and causes the apparatus to move along the I-beam in the desired direction.

Positioning motor 18, via a transmission or gear reduction element 20, as well as a force multiplying cable and pulley apparatus generally designated as 22, serves to raise the apparatus to the stored position, as explained in greater detail hereinafter, as well as lowering and securing it in the operational position. The 80 to 1 gear reduction plus the cable and pulley multiplication of 2 assures sufficient restraining force to secure the apparatus in its down or operational position. Also located adjacent the track to avoid inertial problems are fluid reservoirs 23 (only one of which is shown) to provide the required fluid. A compressor air tank is also mounted, but not shown, upon the upper driving and supporting mechanism.

A hollow rigid arm member 6 extends from the track and driving apparatus downwardly to a position in close proximity to the alley surface. The rigid arm 6 would normally be of a hollow or tubular structure to both preserve weight and further to provide a protective enclosure for the various electrical and fluid conduits necessary for the operation of the apparatus. It is to be understood that arm 6 could be of solid structure and include means to secure the conduits exteriorly. As seen in FIG. 1, the lower terminus of the arm 6 serves as a support for the manifold 25 as well as for the roller drive motor 24 and its associated gear box 26. Extending diagonally outwardly from opposite sides of the arm 6 perpendicular to the track 10 are a pair of rigid arms 28 which terminate in a pair of horizontal frame elements 30. The frame elements 30 are of sufficient length to support a scrubbing roller and a conditioning squeegee capable of servicing the entire width of an alley.

Pivotly mounted to the opposite ends of each of the horizontal frame members 30 are a pair of laterally extending support elements 32 which extend horizontally outwardly in both directions and have secured to their opposite ends the scrubbing roller 34 and the conditioning squeegee 36, described in detail hereafter. Mounted to a vertical upright 38, rigidly secured to the frame member 30 intermediate the ends thereof, is a two-way pneumatic ram 40 which pivots the horizontal support 32 abouts its axis thereby selectively placing either the scrub roller 34 or the conditioning squeegee 36 in contact with the alley itself. As can be seen, the drive motor 24 mounted to the bottom of arm 6 generates rotational motion which, via gear box 26 drives shafts 42 and pulleys 42 and 48 interconnected by drive belt 50 providing the drive for continual rotation of the scrub brush 34 during the scrubbing operation.

As was explained hereinabove, storage reservoirs for the various liquids are provided at the upper terminus of arm 6 such that the inherent weight and inertia of the stored fluids will not have to be overcome when raising and lowering the apparatus. The solvent is carried from the appropriate storage container to the manifold 22 via conduits suitably contained in the arm 6 and then transferred outwardly by means of multiple conduits 62 to individual nozzles 62 whereat the solvent and/or the conditioning fluid is automatically dispensed at the appropriate time assuring a uniform converage and an adequate supply of fluids.

As will be readily apparent, the time of the dispensing is controlled by the position of the apparatus and involves relatively straight forward timing mechanisms and thus will not be described in detail.

Mounted at the outer end of each of the horizontal frame members 30 is a gutter cleaner 66 which dusts the gutter as the apparatus moves forward and backward along the alley surface servicing the entire structure.

As can best be seen in FIG. 2, the scrubbing device includes a hollow cylindrical element, for minimal weight, surrounded by a felt pad 70 which contacts the surface of the alley and can easily be replaced when dirty or worn. The squeegee for the conditioning fluid includes a rigid element upon which is mounted a rubberized pad 72 to which is attached a felt pad 74 again easily removed and replaced when necessary.

Figure 3:
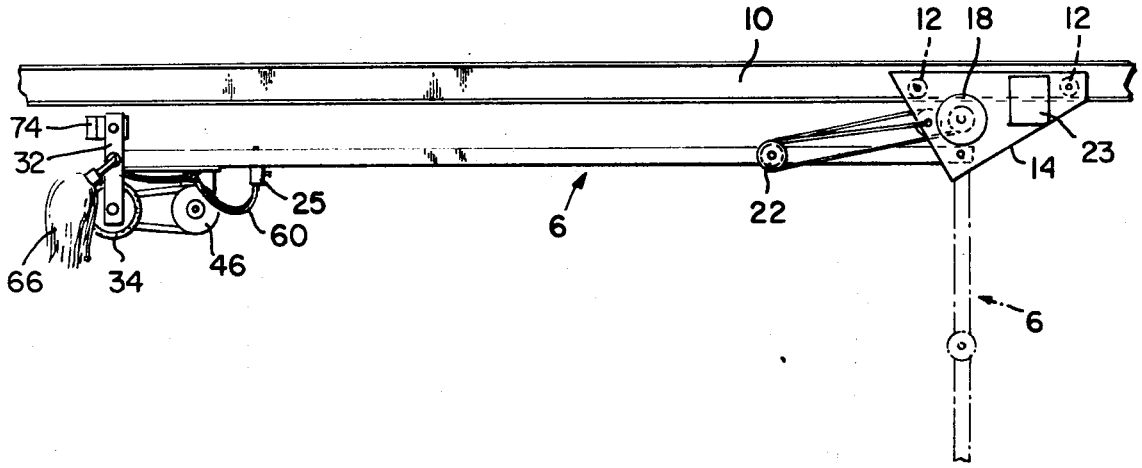
FIG. 3 is a side elevational view of the mechanism in the stored position.

Referring now to FIG. 3, the entire apparatus can be seen in a stored position, i.e. that position adjacent the ceiling or track mechanism, a position whereat the apparatus is hidden from view behind the score display board.

Figure 4:
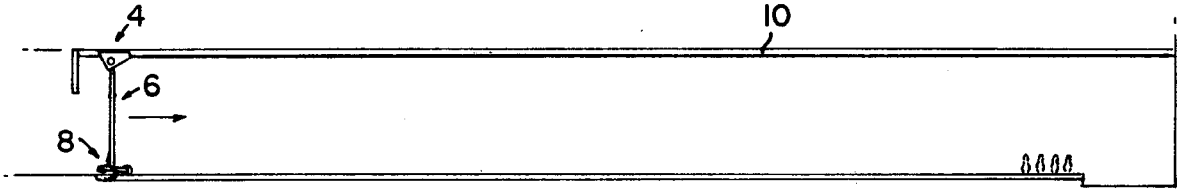
FIG. 4 is a schematic representation of the mechanism at the end of the scrubbing operation.
Figure 5:
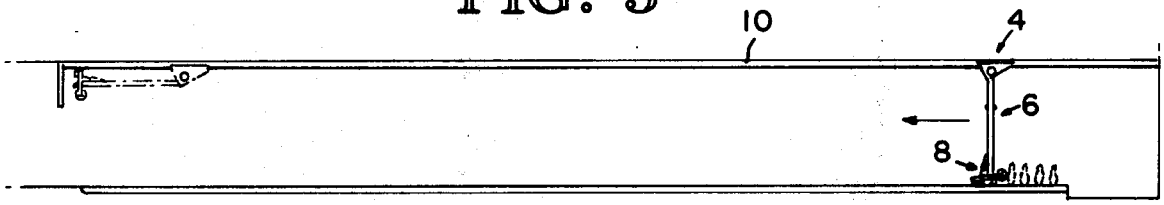
FIG. 5 is a schematic view of the mechanism at the end of the oiling operation and also shown in phantom in the stored position.

FIGS. 4 and 5 depict schematically the operation, which takes approximately 71 seconds to complete. When it is necessary for the alley to be serviced, the arm and servicing apparatus pivot downwardly and the dolley or bogie mechanism secured to the track moves to a position for starting the operation. The apparatus dispenses solvent on the alley and the scrub brush rotates, removing any of the excess oil and cleans the surface for application of a new oil surface. The apparatus moves toward the opposite and upon reaching the end of the alley, reverses itself and spreads a layer of oil until it again reaches the end of the alley at which point it returns to the stored position.

As can readily be seen, since the apparatus is capable of moving at a rapid rate, it is a simple operation to completely surface a pair of adjacent alleys even during a tournament. The apparatus is of simple structure and thereby requires very little maintenance and can service the alleys with very little down time thus improving the appeal of the alleys attracting more tournaments since the alley will consistently offer a good bowling surface.

What is claimed is:

1. An automated bowling alley servicing mechanism comprising:

central control and distribution apparatus movable along the length of the alley for assuring proper tracking of the mechanism as well as providing the driving force and materials for the servicing operations, a pair of oppositely extending rigid support members adjustably secured to and movable with the central control and distribution apparatus, each of said support members including dispensing means for a solvent and an alley conditioning oil, scrubbing means for use in conjunction with the solvent and distribution means for the oil whereby the alley is uniformly serviced, and means to move the mechanism from a stored position adjacent the ceiling above an adjacent pair of alleys to be serviced to an operational position adjacent to alley surface, move the mechanism the length of the alley and return the mechanism to the stored position.

2. Apparatus for automatically and simultaneously servicing a pair of adjacent bowling alleys comprising:

control and guidance means secured to the ceiling above the alleys, collapsible rigid arm means secured to the control and guidance means movable from a first collapsed condition adjacent the ceiling to an extended condition whereat one end is in close proximity to the alley, servicing mechanism secured to the arm means and movable therewith including means to distribute solvent in conjunction with a scrubbing apparatus and means to distribute finishing liquid in conjunction with a spreading apparatus whereby a pair of adjacent bowling alleys may be completely serviced by one full cycle of the apparatus.

3. Apparatus as in claim 2, wherein the control and guidance means comprises a track means extending the length of the alley and substantially parallel thereto.

4. Apparatus as in claim 3, wherein the rigid arm means is secured to a motorized bogie and is moved the length of the alley thereby.

5. Apparatus as in claim 4, wherein the liquid required for the servicing is stored in containers mounted upon the bogie.

6. Apparatus as in claim 2, wherein the servicing mechanism extends laterally of the collapsible rigid arm means and has pivotally mounted thereon a pair of spaced arm members supporting a scrub brush and a distributor for the finishing liquid such that if either the brush or the distributor are in contact with the alley, the other will not be in contact.

7. Apparatus as in claim 2, and further including means to clear the gutter.

* * * * *